US006247827B1

(12) United States Patent
Carter

(10) Patent No.: US 6,247,827 B1
(45) Date of Patent: Jun. 19, 2001

(54) FLOATABLE LIGHTING ASSEMBLY

(75) Inventor: Ronald S. Carter, Akron, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 09/556,746

(22) Filed: Apr. 21, 2000

(51) Int. Cl.[7] ..... F21V 33/00

(52) U.S. Cl. ..... 362/101; 362/294; 43/17.5; 441/16

(58) Field of Search ..... 362/101, 294, 362/373, 345; 43/17.5; 441/13, 16

(56) References Cited

U.S. PATENT DOCUMENTS

| | | | |
|---|---|---|---|
| 3,464,139 | | 9/1969 | Eggers . |
| 3,617,733 | | 11/1971 | Adams . |
| 3,833,955 | | 9/1974 | Hulbert, Jr. . |
| 3,893,201 | | 7/1975 | Mallory . |
| 4,280,173 | * | 7/1981 | Bradley et al. ..... 362/294 |
| 4,553,194 | | 11/1985 | Bailey . |
| 5,133,145 | | 7/1992 | McDonald . |
| 5,184,414 | | 2/1993 | Downs . |
| 5,651,209 | | 7/1997 | Rainey . |
| 6,030,264 | | 2/2000 | Carter . |

* cited by examiner

*Primary Examiner*—Stephen Husar
(74) *Attorney, Agent, or Firm*—Watts, Hoffmann, Fisher & Heinke, Co., L.P.A.

(57) ABSTRACT

An improved floatable lighting assembly includes a base with a central concave wall that can face a liquid surface and a peripheral portion extending around the concave wall. A shell is constructed so as to extend from the peripheral portion to form a chamber around the concave wall that provides the lighting assembly with buoyancy. A lamp has a lower light-emitting portion and an electrical contact portion. The electrical contact portion is disposed in an interior region formed by the concave wall. A heat shield is disposed between the shell and the lamp. Electrical wire is electrically connected to the contact portion of the lamp. Structure in the base directs electrical wire from a lower portion of the base into the liquid. The electrical cable includes a loop strain relief member for preventing the cable from pulling away from the structure during use of the lighting assembly.

15 Claims, 3 Drawing Sheets

FLOATABLE LIGHTING ASSEMBLY

FIELD OF THE INVENTION

The present invention relates to a floatable lighting assembly and, in particular, to a lighting assembly powered by a remote power source.

BACKGROUND OF THE INVENTION

Various lighting assemblies have been constructed for use in water. Floatable lighting assemblies are often used for providing a warning to boats and for attracting fish for fishing. In both cases the lighting assembly is typically made from a body comprised substantially of a buoyant material. Electrical wiring from a power source such as a battery enters the top or side of the lighting assembly. These designs avoid exposing the electrical connection between the lighting assembly and the wiring to water and generally avoid submerging the electrical wiring in the water.

One example of a floatable lighting assembly is disclosed in U.S. Pat. No. 3,833,955. This lighting assembly employs a body formed of foamed polyurethane for providing it with buoyancy. The contact portion of the lamp is enclosed in the body and isolated from wetness. Electrical wiring enters the top of the lighting assembly.

One problem encountered with prior art floatable lighting fixtures is the heat generated by the lighting elements during use. Floatable light fixtures typically include the use of plastic components in its assembly. The plastic components exposed to excessive heat from the lighting elements can melt or burst into flames causing structural integrity of the fixture to fail. As a result, it is possible that water may come in contact with the electrical connections within the fixture creating a very hazardous and dangerous situation.

Another problem with floatable lighting fixtures is encountered during the removal or positioning of the fixture in water. Typically, these fixtures are removed from the water or repositioned in the water by pulling on the electrical cord. This creates considerable stresses to the point of attachment with the lighting fixture. As such, it has been determined that the electrical cord can become detached during repeated use.

The present invention is directed to an improved floatable lighting fixture that is simple, economical, and safe to use. The present invention reduces the hazards of using an electrical device in water. The inventive floatable light fixture employs a heat shield that dissipates the heat generated from the lighting elements during use. The electrical cord contains a looped strain relief member that prevents the electrical contacts from being detached during use.

SUMMARY OF THE INVENTION

In general, the present invention is directed to an improved floatable lighting assembly comprising a base that includes a central concave wall that can face a liquid surface and a peripheral portion extending around the concave wall. A shell is constructed so as to extend from the peripheral portion to form a chamber around the concave wall that provides the lighting assembly with buoyancy. A lamp has a lower light-emitting portion and an electrical contact portion that is disposed in an interior region formed by the concave wall. Electrical wire is electrically connected to the contact portion of the lamp. Structure of the base directs the electrical wire from a lower portion of the base into the liquid.

More specifically, the peripheral portion is generally U-shaped in section. The shell is connected to the base as a separate member. A retaining ring is disposed around the light-emitting portion of the lamp and fastened to the base and an O-ring is disposed between the retaining ring and the lamp. A strain relief member is carried by the retaining ring. The peripheral portion of the base has a generally circular shape and the shell is generally dome shaped. The base and the shell are preferably formed of nonmetallic material. The shell and base may cooperate to form interlocking surfaces between which a water-resistant material is disposed. As a result of the interlocking joint and water-resistant material, the chamber is preferably water-tight and occupied by substantially only air for providing the lighting assembly with buoyancy. An electrically insulating, water submersible casing is disposed around a portion of the electrical wire that extends in the water. A low voltage transformer is electrically connected to the electrical wire.

A preferred embodiment of the floatable lighting assembly of the invention comprises the base including a central concave wall that can face the liquid surface and the peripheral portion extending around the concave wall. The peripheral portion is generally U-shaped in section. The shell is constructed so as to extend from the peripheral portion to form a water-tight chamber around the concave wall, the chamber being occupied by substantially only air to provide the lighting assembly with buoyancy. The lamp is fastened to the base, the lamp including the lower light-emitting portion and having the electrical contact portion disposed in the interior region formed by the concave wall. A heat shield is disposed between the shell and the lamp. Preferably, the heat shield is disposed between the concave wall of the base and electrical contact portion of the lamp. The heat shield is comprised of a heat resistant material, such as aluminum. The electrical wire is electrically connected to the contact portion of the lamp. A passageway is constructed and arranged in the base for directing the electrical wire from a lower portion of the base into the liquid.

The floatable lighting assembly offers numerous advantages in design, safety and reliability. The present invention need not include a buoyant material in the chamber, but rather can utilize air to provide the lighting assembly with buoyancy, which reduces the cost of fabrication. The lighting assembly may employ a separate shell and base, which are bonded together to make the chamber water-tight. The foregoing features enable the lighting assembly to be fabricated easily and cost effectively by injection molding.

Using the low voltage transformer and the insulative casing around the wire provides the lighting assembly with safety and reliability. Because of the low voltage to which the lamp is exposed, the interior region that is formed by the concave wall need not be completely sealed from water. The passageway into the interior region need not be sealed and enables the lighting assembly to operate effectively and reliably even when there is wetness in the interior region. Finally, the electrical wire, being directed from the lower portion of the lighting assembly into the water, is less conspicuous to the observer. In addition, the wire is protected from entanglement and from damage by being disposed under the water.

Many additional features, advantages and a fuller understanding of the invention will be had from the accompanying drawings and the detailed description that follows.

DETAILED DESCRIPTION OF PREFERRED EMBODIMENTS

Figures 2, 2A:
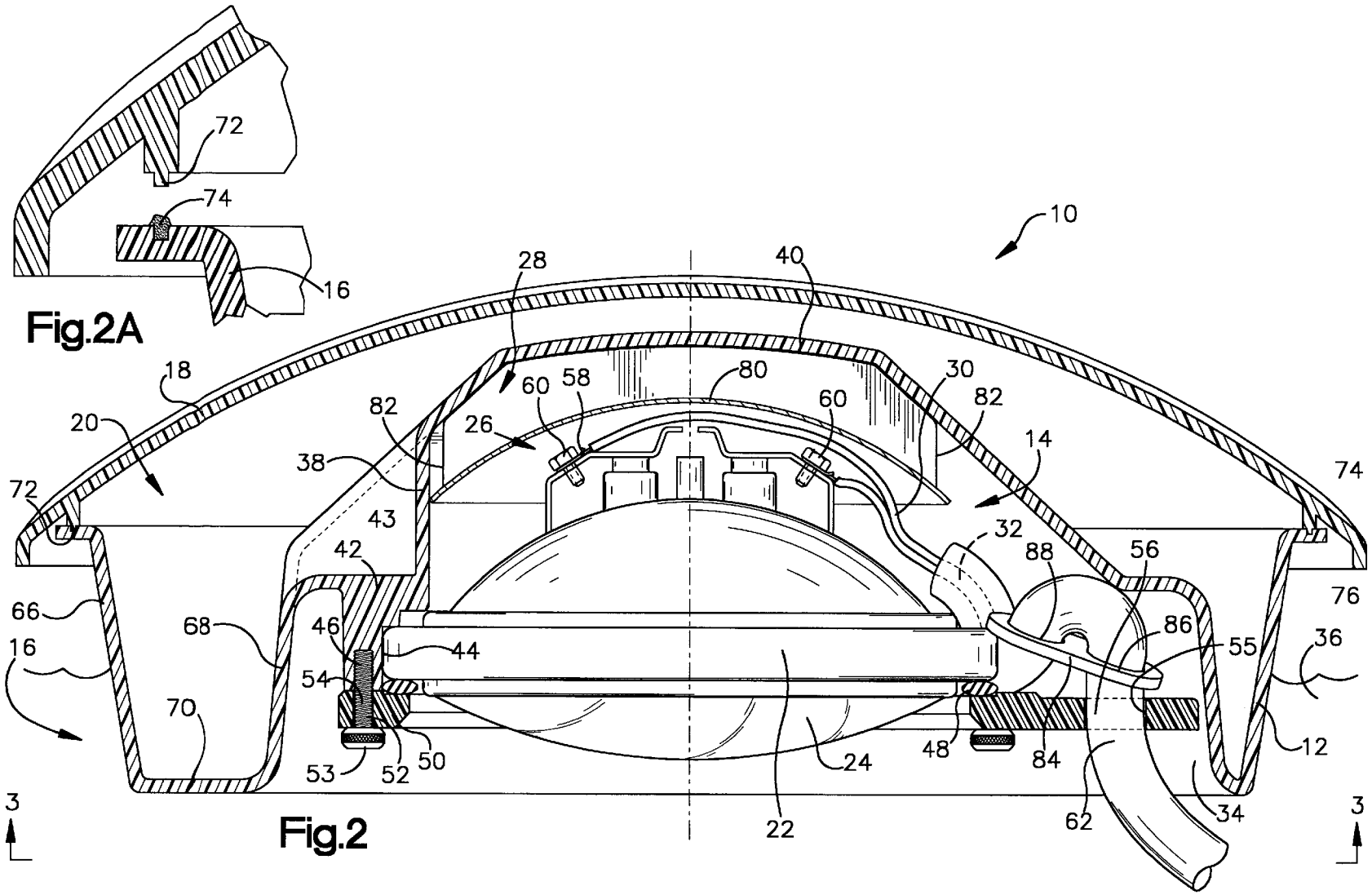
FIG. 2 is a cross-sectional view of the lighting assembly of FIG. 1.
FIG. 2A is an enlarged partial cross-sectional view of FIG. 2, which shows an interlocking joint that has been omitted from the other Figures for clarity.
Figure 3:
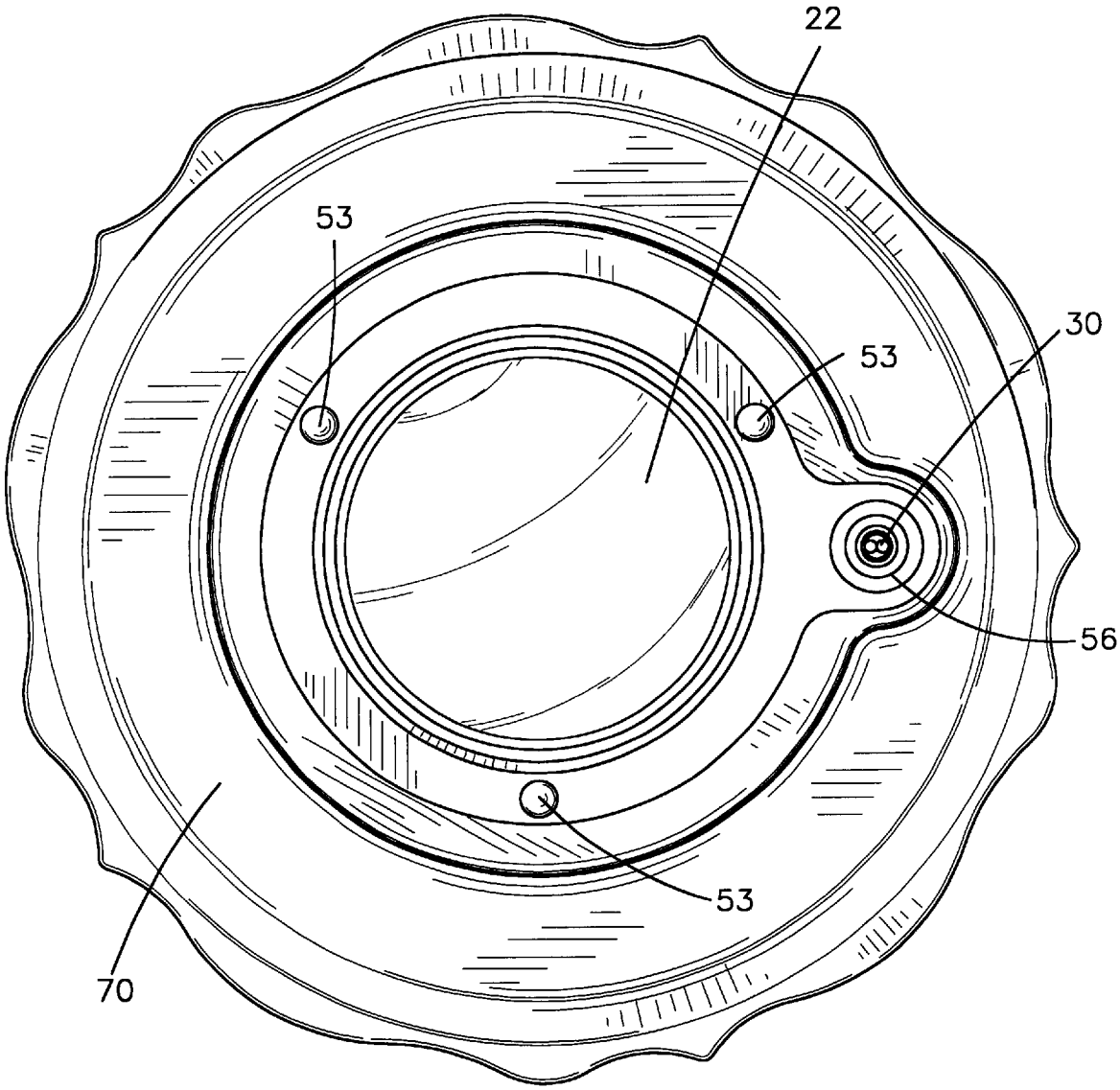
FIG. 3 is a view of the lighting assembly as seen in a direction designated by the lines 3—3 in FIG. 2.

Referring now to the drawings, a floatable lighting assembly of the invention is shown generally at 10. The lighting assembly has a base 12 that includes a central concave wall 14 that can face a water surface and a peripheral portion 16 extending around the concave wall that is generally U-shaped in cross-section as seen in FIG. 2. A shell 18 forms a chamber 20 with the peripheral portion. A lamp 22 has a lower light-emitting end portion 24 and an electrical contact portion 26 that is disposed in an interior region 28 formed by the concave wall. A heat shield 80 is disposed in the interior region 28 between the electrical contact portion 26 and the concave wall 14. Electrical wire 30 is electrically connected to the contact portion of the lamp. A passageway 32 in the base directs the electrical wire from a lower portion of the base 34 and into the water 36.

The concave wall 14 is generally cup-shaped as seen in FIG. 2 and comprises a side wall 38 and an end wall 40. A section 42 extends between the side wall and the peripheral portion. The section 42 includes a recess 44 configured so as to receive the profile 46 of the lamp.

The lamp is positioned so that its contact portion 26 extends in the interior region 28 with sufficient clearance so that the contact portion does not contact the end wall 40, and such that the lamp profile 46 is received by the recess 44. An O-ring 48 is placed around the lamp. The interior region is sized to avoid excessive heat concentration from the lamp onto the plastic of the base. The O-ring 48 is made of a suitable flexible material, for example, a 100% silicone O-ring as supplied by Vanguard Plastics. A retaining ring 50 is placed on the O-ring. The O-ring acts as a buffer to prevent movement of the lamp. Fasteners such as bolts and nuts are used to secure the retaining ring against the lamp. For example, exteriorly threaded studs 52 are molded into the section 42 of the base and are received in openings in the retaining ring. Interiorly threaded ball-shaped nuts 53 are threaded onto the studs against the retaining ring to securely fasten the lamp to the base. The retaining ring is preferably made of a nylon material, such as Zytel™ brand polymer by Dupont®. The base and shell may be formed of any suitable nonmetallic material, and are preferably comprised of plastic material such as ABS (acrylonitrile-butadiene-styrene) plastic or Zytel™ brand polymer by Dupont®.

The heat shield 80 is disposed in the interior region 28 and between the electrical contact portion 26 and the concave wall 14. The heat shield is attached to the concave wall in a manner well known in the art. For example, hangers 82 extending from the heat shield can be used to hang the shield from the concave wall. The hangers can be attached to the concave wall by conventional means such as a screw or other manner also well known in the art. The heat shield is made from a heat resistant, nonflammable material. Preferably, the heat shield is made from a metal, such as aluminum. Other suitable heat resistant materials will be apparent to those skilled in the art in view of this disclosure. Those skilled in the art will also appreciate that the size and shape of the heat shield should be configured so as to minimize the amount of heat exposed to the shell 18 or concave wall 14 that is generated during use of light 22. The heat shield can be a solid continuous sheet of material or alternatively a mesh or other design. Suitable patterns and shapes will be apparent to one skilled in the art in view of this disclosure. The invention should not be construed as being limited to any particular heat shield design.

The retaining ring 50 includes an opening 55 for receiving the electrical wire. The passageway 32 directs the electrical wire from the interior region 28 to the lower end portion 34 of the base, inwardly of the peripheral portion 16, and into the water. A looped strain relief member 84 is attached to the cable so as to prevent the cable from being pulled out of the assembled light fixture during use. As shown in FIG. 2, the looped strain relief member can be a tabular in shape with openings 86 and 88. The electrical cable is threaded through the two openings so as to prevent the cable from being pulled through opening 55. Alternatively, the looped strain relief member can be s-shaped. Different configurations and sizes of looped strain relief members suitable for use in the present invention will be apparent by those skilled in the art in view of this disclosure.

Electrical connectors 58 are fastened to one end of the electrical wire for electrically connecting the wire to the contact portion 26 of the lamp. The connectors 58 may be U-shaped spade terminals, for example, which are fastened to the contact portion of the lamp using screws 60. The electrical wire is UL listed wire approved for submersible fixtures. The portion of the wire that is threaded through opening 55 and disposed in the water includes a water resistant casing so as to form a cable 62. Suitable wire cable is 18/2 AWG type STW-A PVC water resistant power cord rated for 105° C.

The generally U-shape of the peripheral portion is formed by an exterior side wall 66, an interior side wall 68 and a lower surface 70. The shell has a lower peripheral surface 72. The shell is a separate dome-shaped member that is connected to the peripheral portion of the base in a suitable manner such as bonding. A suitable water-resistant material 74 is applied between the shell and the base. The base includes an upper peripheral surface 76 that has a generally circular shape from above. The surfaces 72 and 76 have an interlocking configuration to prevent water from entering the chamber 20. One suitable interlocking construction of the surfaces 72 and 76 is the dovetail joint-like configuration shown in FIG. 2A. Projections 76*a* from the base surface 76 form a female region 76*b* therebetween. Projections 72*a*, 72*b* extend from the shell, the projection 72*b* extending into the female region 76*b*. A bead of Dow® brand silicone No. 732 water-resistant adhesive 74 is applied between the female base region 76*b* and the shell projection 72*b* and the shell and base are fitted together. Those skilled in the art will appreciate in view of this disclosure that the location and arrangement of the projections and recess may be different, that the recess 76*b* may be formed in the shell and the projection 72*b* that engages it—in the base, and that other types of joints may be used. The interlocking construction prevents water from entering the chamber 20. The chamber is occupied substantially by only air for providing the lighting assembly with buoyancy. It is not necessary for the lighting assembly of the present invention to include a buoyant material in the chamber 20.

Figure 1:
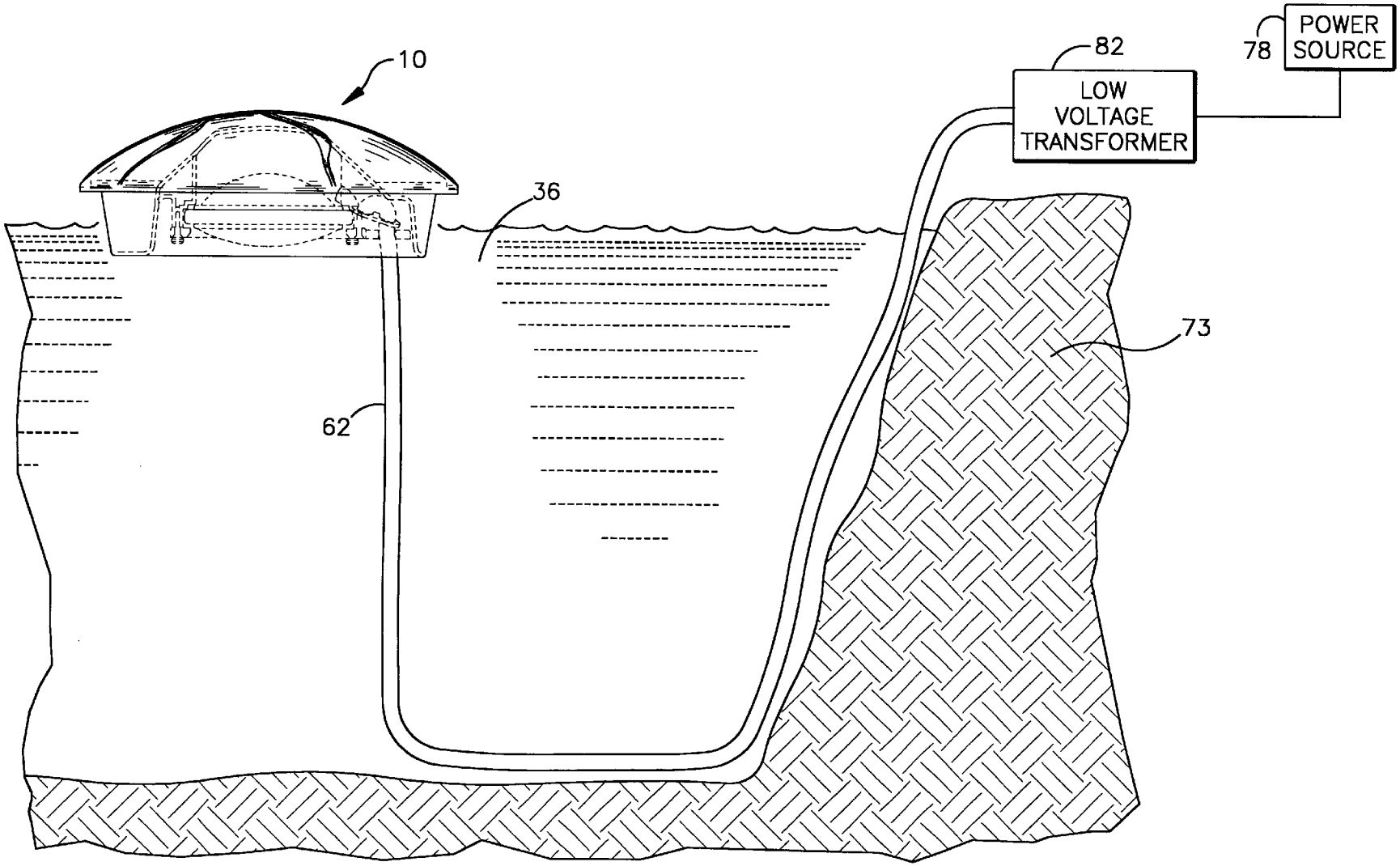
FIG. 1 is a view of a floatable lighting assembly constructed in accordance with the present invention.

The water 36 may be contained in an area 73 such as a pond used in landscaping. As seen in FIG. 1, the electrical cable extends downwardly from the bottom of the base to the bottom of the pond and upwardly along the side wall of the pond to a location outside the pond. The lighting assembly may be tethered so as to remain at a generally fixed location on the water.

The electrical cable extends to the lighting assembly from a power source 78 such as 120 volt AC household current (120 V line voltage). From the power source the wire may be electrically connected to a low voltage transformer 82, for example, a 12 volt DC transformer. The transformer enables the lamp to be used in the wet environment without electrical hazard or shorting. Therefore, the electrical connector end of the lamp may be disposed in the interior region 28 and electrically connected to the wire even though the passageway 32 and thus, the interior region itself, are not sealed against water. The electrical terminals in the interior region 28 may get wet without loss of function of the lighting assembly or creating a hazard.

Only one lamp assembly (including the lamp, the base, the shell and the electrical wire as in FIG. 2) may be electrically connected to the wire, or additional lamp assemblies may be used. In the case of additional lamp assemblies, each lamp assembly would be separately electrically connected to the electrical wire and spaced from the other lamp assemblies. A single power source and low voltage transformer may be used with the multiple lamp assemblies.

Many modifications and variations of the invention will be apparent to those skilled in the art in light of the foregoing disclosure. Therefore, it is to be understood that, within the scope of the appended claims, the invention can be practiced otherwise than has been specifically shown and described.

What is claimed is:

1. A floatable lighting assembly comprising:

a base including a central concave wall that can face a liquid surface and a peripheral portion extending around said concave wall;

a shell that is constructed so as to extend from said peripheral portion to form a chamber around said concave wall that provides said lighting assembly with buoyancy;

a lamp having a lower light-emitting portion and an electrical contact portion, said electrical contact portion being disposed in an interior region that is formed by said concave wall;

a heat shield disposed between the shell and the lamp;

electrical wire that is electrically connected to said contact portion; and structure in the base for directing said electrical wire from a lower portion of said base into the liquid.

2. The floatable lighting assembly of claim 1 wherein the heat shield is disposed between the central concave wall of the base and the electrical contact portion of the lamp.

3. The floatable lighting assembly of claim 1 wherein the heat shield is formed of a heat resistant material.

4. The floatable lighting assembly of claim 3 wherein the heat resistant material comprises aluminum.

5. The floatable lighting assembly of claim 1 further comprising a loop strain relief member supported by a retaining ring disposed around said light-emitting portion of said lamp and fastened to said base wherein a portion of the electrical wire is threaded through the looped strain relief member for preventing the electrical wire from becoming detached from the electrical contact portion during use.

6. An improved floatable lighting assembly comprising a base including a central concave wall that can face a liquid surface and a peripheral portion extending around said concave wall; a shell that is constructed so as to extend from said peripheral portion to form a chamber around said concave wall that provides said lighting assembly with buoyancy; a lamp having a lower light-emitting portion and an electrical contact portion, said electrical contact portion being disposed in an interior region that is formed by said concave wall; electrical wire that is electrically connected to said contact portion; and structure in the base for directing said electrical wire from a lower portion of said base into the liquid, the improvement comprising:

a heat shield disposed between the shell and the lamp.

7. The improved floatable lighting assembly of claim 6 comprising a loop strain relief member supported by a retaining ring disposed around said light-emitting portion of said lamp and fastened to said base wherein a portion of the electrical wire is threaded through the looped strain relief member for preventing the electrical wire from becoming detached from the electrical contact portion during use.

8. The improved floatable lighting assembly of claim 6 wherein the heat shield is disposed between the central concave wall of the base and the electrical contact portion of the lamp.

9. The improved floatable lighting assembly of claim 6 wherein the heat shield is formed of a heat resistant material.

10. The improved floatable lighting assembly of claim 9 wherein the heat resistant material comprises aluminum.

11. The improved floatable lighting assembly of claim 6 wherein said structure in the base includes a loop strain relief member for preventing the electrical wire from pulling away from the structure during use of the lighting assembly.

12. A floatable lighting assembly comprising:

a base including a central concave wall that can face a liquid surface and a peripheral portion extending around said concave wall, said peripheral portion being generally U-shaped in section;

a shell constructed so as to extend from said peripheral portion to form a water-tight chamber around said concave wall, said chamber being occupied by substantially only air to provide said lighting assembly with buoyancy;

a lamp having a lower light-emitting portion and an electrical contact portion, said electrical contact portion being disposed in an interior region formed by said concave wall;

a heat shield disposed between the shell and the lamp;

electrical wire that is electrically connected to said contact portion; and a passageway constructed and arranged in the base for directing said electrical wire from a lower portion of said base into the liquid.

13. The floatable lighting assembly of claim 12 comprising a retaining ring disposed around said light-emitting portion of said lamp and fastened to said base; an O-ring disposed between said retaining ring and said lamp and a loop strain relief member supported by said retaining ring wherein a portion of the electrical wire is threaded through the looped strain relief member for preventing the electrical wire from becoming detached from the electrical contact portion during use.

14. The floatable lighting assembly of claim 12 wherein said electrical cable includes a loop strain relief member for preventing the cable from pulling away from the passageway during use of the lighting assembly.

15. The floatable lighting assembly of claim 12 comprising a heat shield disposed between the central concave wall of the base and the electrical contact portion of the lamp.

* * * * *